US006230941B1

(12) United States Patent
Amberg

(10) Patent No.: US 6,230,941 B1
(45) Date of Patent: May 15, 2001

(54) DRIVE MECHANISM FOR AGITATOR BLADES IN A PASTE CONTAINER

(75) Inventor: Guenther Amberg, Neuss (DE)

(73) Assignee: Henkel Ecolab GmbH Co. OHG, Duesseldorf (DE)

( * ) Notice: Subject to any disclaimer, the term of this patent is extended or adjusted under 35 U.S.C. 154(b) by 0 days.

(21) Appl. No.: 09/446,689

(22) PCT Filed: Jun. 15, 1998

(86) PCT No.: PCT/EP98/03594

§ 371 Date: Apr. 3, 2000

§ 102(e) Date: Apr. 3, 2000

(87) PCT Pub. No.: WO98/59103

PCT Pub. Date: Dec. 30, 1998

(30) Foreign Application Priority Data

Jun. 24, 1997 (DE) ..... 197 26 706

(51) Int. Cl.[7] ..... G01F 11/00

(52) U.S. Cl. ..... 222/235; 222/229; 222/386; 222/405; 222/408.5

(58) Field of Search ..... 222/228, 229, 222/232–235, 319, 385, 386, 405, 408.5, 413

(56) References Cited

U.S. PATENT DOCUMENTS

| | | | | |
|---|---|---|---|---|
| 1,851,044 | * | 3/1932 | Genovesi | 222/232 |
| 1,859,290 | * | 5/1932 | Davis | 222/235 |
| 2,895,648 | * | 7/1959 | Woughter | 222/235 |
| 2,990,978 | * | 7/1961 | Charos | 222/235 |
| 4,160,514 | * | 7/1979 | Taupin | 222/228 |
| 4,174,788 | * | 11/1979 | Casagrande | 222/235 |
| 4,790,456 | * | 12/1988 | Nakane et al. | 222/386 |
| 5,244,020 | * | 9/1993 | Bruno et al. | 222/228 |
| 5,662,248 | * | 9/1997 | Collard, Jr. | 222/235 |
| 5,785,210 | | 7/1998 | Amberg et al. | 222/229 |

FOREIGN PATENT DOCUMENTS 43 32 850 3/1995 (DE) .

* cited by examiner

*Primary Examiner*—J. Casimer Jacyna
(74) *Attorney, Agent, or Firm*—Wayne C. Jaeschke; Glenn E. J. Murphy; Kenneth Watov

(57) ABSTRACT

The invention relates to a paste container with a follower plate tightly sealing the open side of the container. A multiblade mixing propeller is fitted to the follower plate in such a way that it can be rotated, a short distance beneath the follower plate, around an axle (5) which juts through the middle of the plate. The paste container includes a removal device with an external drive mechanism with which paste can be removed from the container through an opening in the follower plate. The agitator blades and the removal device have the same drive mechanism. The paste container is used in particular for receiving thixotropic pastes.

9 Claims, 1 Drawing Sheet

DRIVE MECHANISM FOR AGITATOR BLADES IN A PASTE CONTAINER

BACKGROUND 1.0 Field of the Invention

This invention relates generally to paste containers, and more particularly to paste containers including dispensing mechanisms.

2.0 Discussion of Related Art

Paste-form detergents are growing in importance and are being increasingly used in laundries. Paste-form detergents have the advantages of powder-form detergents, especially their high active-ingredient contents, but none of the disadvantages of liquid detergents, especially their water or solvent contents. Paste-form detergents are often pseudoplastic or thixotropic pastes, more particularly high-viscosity detergent pastes, which are mainly used in institutional laundries.

Pseudoplastic or thixotropic pastes have the property whereby their viscosity is reduced by mechanical shearing, for example by stirring or shaking or under the effect of ultrasound, but is restored after removal of the mechanical stress. This means that this property whereby the viscosity of such pastes decreases under the effect of increasing shear stress or shear rate can be utilized to make handling easier. Unfortunately, these properties of paste-form detergents, especially high-viscosity pastes, also cause particular packaging and handling problems.

German patent application P 43 32 850 describes a paste container with a removal system which is suitable for accommodating and removing pastes. It consists of a cylinder open on one side and a tightly closing follower plate arrangement for displacement on the open side of the cylinder, and comprises a removal system for removing and transporting the paste. A geared motor is mounted on the follower plate, a multiple-blade propeller stirrer being arranged on the shaft of the motor which extends centrally through the follower plate. The propeller stirrer is positioned just below the follower plate, and is able to turn freely in the paste, the viscosity of the thixotropic paste being reduced under the shearing effect. The paste which thus becomes easy to transport is delivered by the propeller stirrer to a removal system which transports the paste through an opening in the follower plate, and which comprises an external drive mechanism.

This solution has the disadvantage that it is very expensive. The separate drives for the propeller stirrer and the removal system are expensive and, because of the space they require, are difficult to accommodate above the paste container.

SUMMARY OF THE INVENTION

An object of the present invention is to provide an improved paste container with a removal system for reducing manufacturing and operating costs, and for providing compact packaging. In one embodiment of the invention, this object is met by providing a paste container with a propeller stirrer and removal system that share the same drive mechanism.

The paste container according to the invention has the advantage that the use of the same drive for the propeller stirrer and removal system leads to a distinct reduction in manufacturing and operating costs, and the limited space above the paste container can be better and more efficiently utilized through the elimination of a unit. Since, in order to reduce the viscosity of, and to transport, the thixotropic paste, the paste need only be stirred when it is also to be removed, the amalgamation of the drives of the propeller stirrer and the removal system is particularly advantageous.

This drive combination is particularly favorable in an embodiment in which the removal system comprises a rotation shaft of a feed element arranged perpendicularly of the follower plate. This can be solved particularly advantageously by the use of a screw pump which transports the paste delivered by the propeller stirrer outwards.

Where the removal system is non-centrally arranged, the distance to the shaft of the propeller stirrer can readily be bridged by interengaging gearwheels or a belt drive. If the removal system is centrally arranged on the follower plate, the propeller shaft or boss may be formed with particular advantage by lengthening the shaft of the feed element on the axis of rotation of the screw.

In one particular embodiment where the transported paste is delivered to an injector, the feed line is designed to be closed by a shutoff element, for example a ball cock, whereby the flow of paste can be briefly interrupted with particular advantage until a substantially constant feed volume has been established.

BRIEF DESCRIPTION OF THE DRAWING

Various embodiments of the invention are described with reference to the drawing, which shows a partial cut-away view of a side elevational view of the subject paste container, and associated stirrer feed or dispenser mechanism.

DETAILED DESCRIPTION OF THE INVENTION

Figure 1:
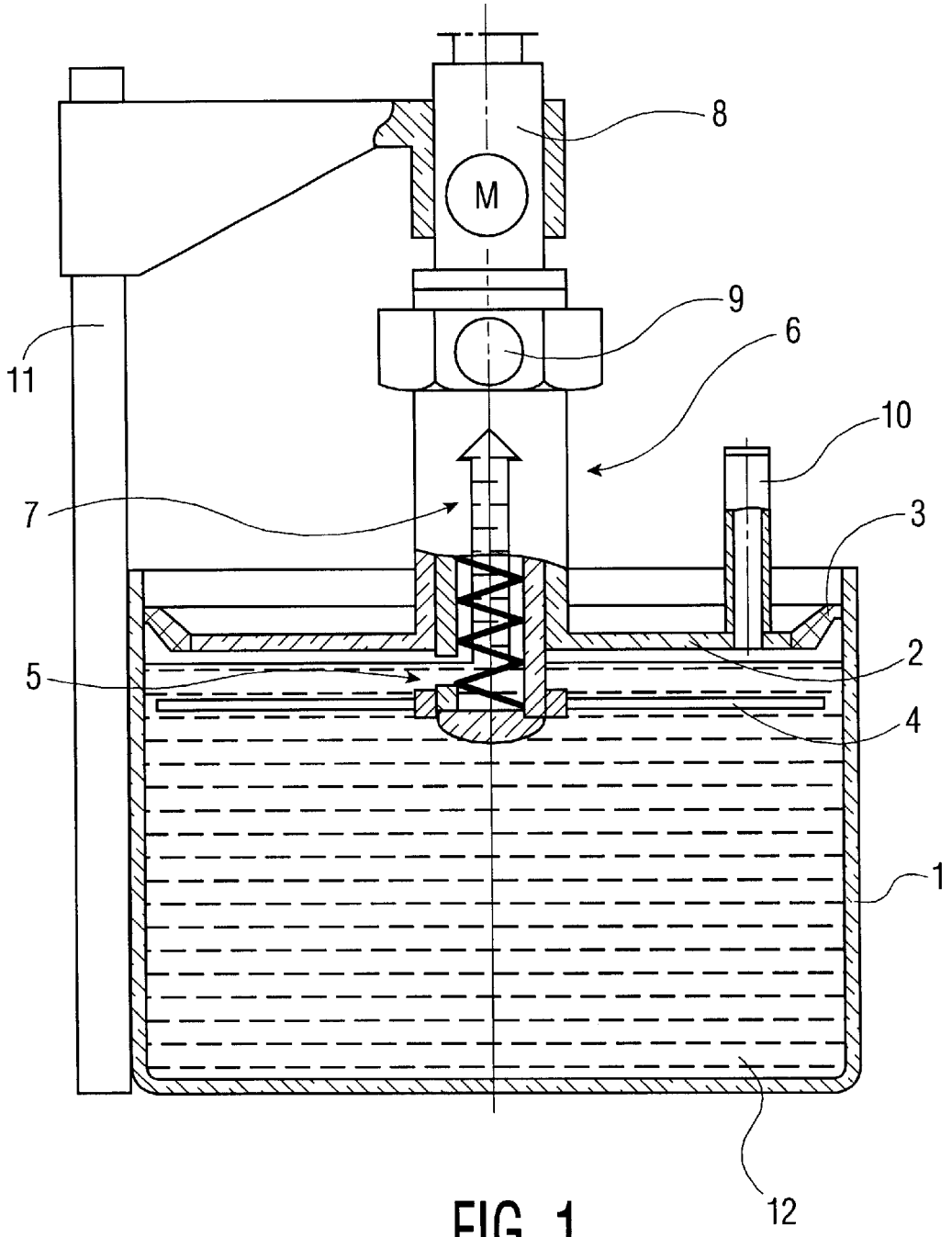

The drawing shows a cylindrical paste container 1 which is tightly closed by a follower plate 2, the follower plate 2 forming a seal with the inner wall of the paste container 1. A propeller stirrer 4 is mounted on a shaft formed by an extension of the axis of rotation of the screw.

The feed element 6 comprises a central feed passage 7 in which a screw transporting element 5 rotates. The drive shared by the propeller stirrer 4 and the feed screw 5 is the motor 8 which is slidingly fixed to and guided by a guide 11 via a holder. In this way, the combination of the removal system 6 and the propeller stirrer 4, including the common drive 8, can be vertically moved when the follower plate 2 follows the falling level of the thixotropic paste 12 as the latter is removed. The vent screw 10 has to be opened if the follower plate 2 is to be withdrawn after emptying of the paste container 1.

The amount of paste removed by the removal system 6 is determined by the rotational speed and by other influencing factors, such as the passage diameter, screw volume and pitch. If the removal system 6 is non-centrally arranged, the particular rotational speeds can be adapted to meet specific functional requirements through the design of the gearing between the shafts of the removal system 6 and the propeller stirrer 4. If the shaft of the propeller stirrer 4 is formed by an extension of the feed element shaft, the propeller stirrer 4 rotates at the same speed as the removal system so that inter alia the viscosity of the thixotropic paste is determined in this manner. In this case, the rotational speed of the propeller stirrer 4 should be adjusted with the required paste consistency in mind. On this basis, the feed volume is determined as a function of the other influencing factors.

A feed line (not shown) to a metering injector (not shown) may be disposed at the opening 9. The feed line to the injector can be briefly closed by a ball cock. Depending on the length of the metering lines, the injector has to overcome a certain counterpressure after opening of and water valve before it develops full power. The effect of this can be that water is briefly forced into the paste line and, with extremely short metering times when the pump is unable to build up its full pressure, can enter the section between the ball cock and the paste pump. Here, the highly alkaline paste can harden in the event of relatively long stoppages of the metering system, resulting in blockage of the injector. Similarly, the ball cock enables the hoses to be rinsed in the closed state without any contact with the paste 12.

What is claimed is:

1. A paste container comprising a follower plate which tightly seals the open side of the container, and on which a multiple-blade propeller stirrer is arranged in such a way that it is able to rotate just below the follower plate about a shaft extending centrally therethrough, and a removal system with an external drive with which paste can be removed from the container through an opening in the follower plate, wherein the propeller stirrer and the removal system have the same drive.

2. A paste container as claimed in claim 1, wherein the removal system comprises a feed element which rotates about an axis extending perpendicularly of the follower plate.

3. A paste container as claimed in claim 2, wherein the removal system is a screw pump which transports the paste delivered by the propeller stirrer outwards.

4. A paste container as claimed in claim 3, wherein the removal system is centrally arranged, and the propeller shaft is formed by an extension of the axis of rotation of the screw.

5. A paste container as claimed in claim 3, wherein the removal system delivers the transported paste to an injector, the feed line being designed to be closed by a closure element.

6. A paste container as claimed in claim 2, wherein the removal system is centrally arranged, and the propeller shaft is formed by an extension of the axis of rotation of the screw.

7. A paste container as claimed in claim 6, wherein the removal system delivers the transported paste to an injector, the feed line being designed to be closed by a closure element.

8. A paste container as claimed in claim 2, wherein the removal system delivers the transported paste to an injector, the feed line being designed to be closed by a closure element.

9. A paste container as claimed in claim 1, wherein the removal system delivers the transported paste to an injector, the feed line being designed to be closed by a closure element.

* * * * *